US006087643A

United States Patent [19]

Park

[11] Patent Number: 6,087,643

[45] Date of Patent: Jul. 11, 2000

[54] METHOD FOR CONTROLLING CAVITY LAMP OF MICROWAVE OVEN

[75] Inventor: Heui-Jung Park, Incheon, Rep. of Korea

[73] Assignee: Daewoo Electronics Co., Ltd., Seoul, Rep. of Korea

[21] Appl. No.: 09/100,235

[22] Filed: Jun. 19, 1998

[30] Foreign Application Priority Data

Jun. 19, 1997 [KR] Rep. of Korea ..... 97-25630

[51] Int. Cl.[7] ..... H05B 6/68

[52] U.S. Cl. ..... 219/702; 219/719; 219/758; 219/723

[58] Field of Search ..... 219/758, 719, 219/702, 723, 722

[56] References Cited

U.S. PATENT DOCUMENTS 4,166,137 8/1979 Buck ..... 219/707
4,433,232 2/1984 Tachikawa et al. ..... 219/756
4,539,453 9/1985 Miyazaki et al. ..... 219/722

OTHER PUBLICATIONS

WPI Abstract Accession No. 94–270024 [33 ] & KR 930828 B1 (Goldstar Co Ltd) Aug. 27, 1993.

*Primary Examiner*—Philip H. Leung
*Attorney, Agent, or Firm*—Pillsbury Madison & Sutro LLP

[57] ABSTRACT

A method for controlling a cavity lamp of a microwave oven has a step of determining whether a door is opened. A cooking state is identified by determining whether a cooking key of a key input portion is selected when the door is opened. Whether the cooking cancellation key of the key input portion is selected when the door is not opened in the cooking state is identified. A cavity lamp is turned off when the cooking cancellation key is selected. Whether an open time of the door passes beyond an established predetermined time in advance is determined. The cavity lamp is turned off when the open time of the door passed beyond the predetermined time. Therefore, the cavity lamp which is turned on when a door is opened is turned off automatically or manually so that life of the cavity lamp is lengthened and loss of electric power is reduced.

8 Claims, 2 Drawing Sheets

METHOD FOR CONTROLLING CAVITY LAMP OF MICROWAVE OVEN

BACKGROUND OF THE INVENTION

1. Field of the Invention

The present invention relates to a method of controlling a cavity lamp of a microwave oven, and more particularly to a method of controlling a cavity lamp of a microwave oven which automatically or manually turns off the cavity lamp that had been previously turned on when a door was opened, so that life of the cavity lamp is lengthened and loss of electric power is reduced.

2. Description of the Prior Art

Generally, a microwave oven is an electronic product which cooks food by using a high-frequency wave emitted from a magnetron. The microwave oven has a melting function, a heating function, and a cooking function by multi-output of the magnetron. Also, the microwave oven has a grill cooking function in which the heater is used respectively in addition to the magnetron, a combination function in which both the heater and the magnetron are used simultaneously, and an oven function in which hot air is circulated in a cavity by a convection heater and a blowing fan installed in the rear portion of the cavity.

The microwave oven has a sensor-type automatic cooking control method and program-type automatic cooking control method. The sensor-type automatic cooking control method controls cooking time automatically by detecting humidity emitted from the food in accordance with heating by using a humidity sensor. Also, the program-type automatic cooking control method controls heating during an established predetermined cooking time in advance by experimentation in accordance with manual input of an amount of cooking in proportion to the kind of food and amount cooked.

The microwave oven, as shown in FIG. 1, is composed of a microprocessor 2 controlling the whole cooking operation, a key input portion 1 consisting of a matrix key in combination with key detecting port $P_0$~$P_2$ and key scan port $S_0$~$S_2$, and a cavity lamp CL installed in the cavity.

A user puts the food in the cavity and closes the door as a condition for the power to be supplied for cooking. Then the user presses an output key of the key input portion 1 to select output level and presses a start key after selecting a cooking function by pressing a particular cooking key. When the start key is pressed, a pulse signal is outputted to the key input portion 1 through the key detecting port $P_0$~$P_2$ of the microprocessor 2 to be re-inputted through the key scan port $S_0$~$S_2$. At this time the microprocessor 2 detects electric potential of the key input portion synchronized with the inputted pulse signal. Therefore, the microprocessor 2 outputs the control signal corresponding to the recognized key signal through the output port $Q_1$, $Q_2$.

When transistors $TR_1$, $TR_2$ are "on", the main relay RY2 and the sub-relay RY1 are driven. Accordingly, the cavity lamp CL is turned on and the magnetron MG is driven so that the high frequency wave is radiated into the cavity through the antenna, thereby the cooking is started. When the door is opened during cooking, the door open sensing switch D.O.M SW turns "off" so that operation of the microwave oven stops.

The cavity lamp CL is turned on during cooking to allow the user to observe the cooking condition of the food. Simultaneously, because the cavity lamp CL remains on even though the door opens, the user can easily put the food in/out before/after the cooking operation is performed.

However, before/after the door is opened, the cavity lamp CL always remains on. That is, when the user opens the door for a long time before starting to cook, or when the user opens the door for a predetermined time to remove vapor or smell in the cavity, the cavity lamp CL always remains on. Therefore, problem occurs that life of the cavity lamp is shortened, and loss of electric power is increased.

SUMMARY OF THE INVENTION

Therefore, the present invention has been proposed to overcome the above described problems in the prior art, and accordingly it is an object of the present invention to provide a method of controlling a cavity lamp of a microwave oven which automatically or manually turns off a cavity lamp that had been previously turned on when a door was opened, so that life of the cavity lamp is lengthened and loss of electric power is reduced.

To achieve the above objects, the present invention provides a method of controlling a cavity lamp of a microwave oven which comprises the steps of: a) determining whether a door is opened; b) identifying a cooking state by determining whether a cooking key of a key input portion is selected when the door is opened in the step a); c) whether a cooking cancellation key of the key input portion is selected when any cooking key of the key input portion is not selected in the step b); d) determining whether the open time of the door passes beyond a predetermined time in advance when the cooking cancellation key is not selected in step c); and turning off the cavity lamp when the cooking cancellation key is selected in the step c) or when the open time of the door passes beyond the predetermined time in the step d).

Here, preferably, driving of a sub-relay stops so that the cavity lamp is turned off. More preferably, the open time of the door is measured by a timer when the cooking cancellation key is not selected in the third step. The predetermined time is stored in a memory. The sub-relay, the timer, and the memory are controlled by a microprocessor. The method of controlling the cavity lamp further comprises a step of turning on the cavity lamp when the cooking cancellation key is re-selected while the cavity lamp is currently off.

Also, a method of controlling a cavity lamp of a microwave oven in accordance with the present invention comprises the steps of: a) determining whether a door is opened; b) identifying cooking state by determining whether a cooking key of a key input portion is selected when the door is opened; c) identifying whether the cooking cancellation key of the key input portion is selected when the cooling key is not selected; d) turning off a cavity lamp by stopping driving of a sub-relay when the cooking cancellation key is selected in the step c); e) determining whether an open time of the door measured by a timer passes beyond a predetermined time which is established in advance to be stored in a memory when the cooking cancellation key is not selected in the step c); f) turning off the cavity lamp by stopping driving of the sub-relay when the open time of the door passed beyond the predetermined time; and g) turning on the cavity lamp when the cooking cancellation key is re-selected while the cavity lamp is currently off.

Here, the sub-relay, the timer, and the memory are controlled by a microprocessor.

Therefore, the cavity lamp which is turned on when the door is opened is also automatically or manually turned off so that life of the cavity lamp is lengthened and loss of electric power is reduced.

BRIEF DESCRIPTION OF THE DRAWINGS

The above objects and other advantages of the present invention will become more apparent by describing in detail preferred embodiment thereof with reference to the attached drawings in which.

DETAILED DESCRIPTION OF THE PREFERRED EMBODIMENTS

Embodiments of the present invention will now be described below with reference to the figures.

Figure 1:
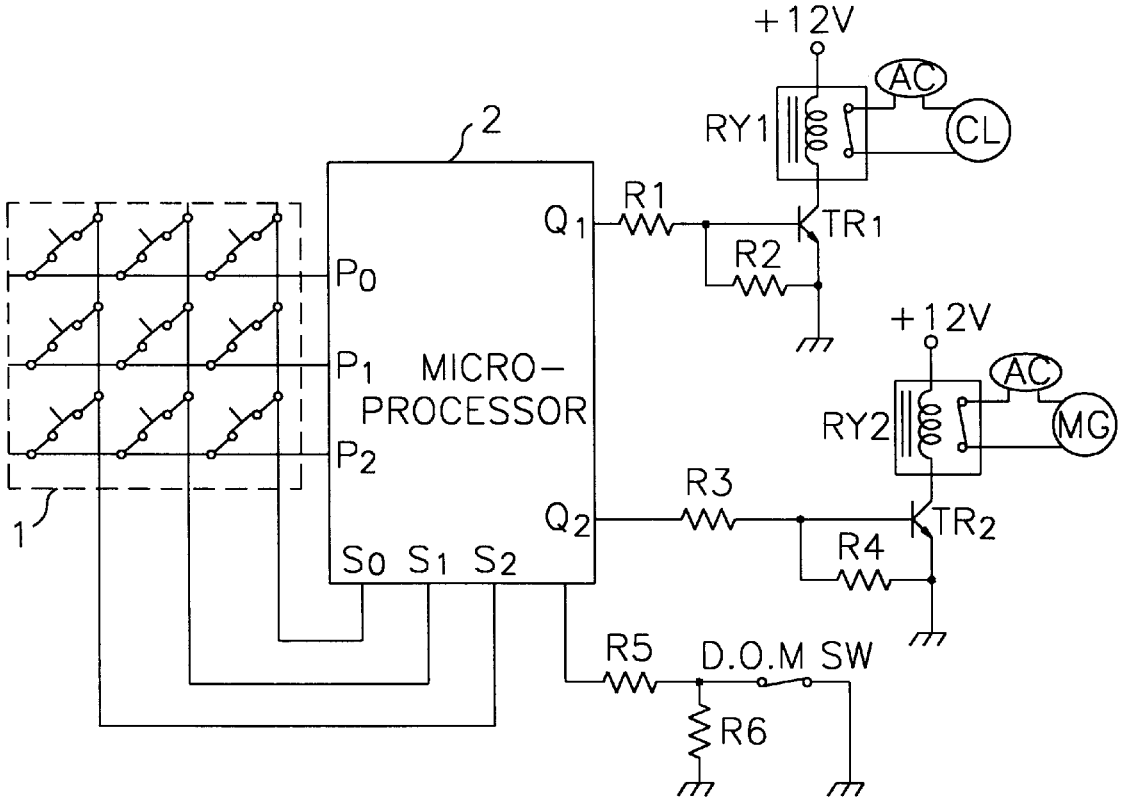
FIG. 1 is a circuit diagram showing driving of the microwave oven by the microprocessor.

The microwave oven having a method for controlling the cavity lamp in accordance with the present invention, as shown in FIG. 1, is composed of a key input portion 1 having a variety of cooking keys and the cooking cancellation key, a cavity lamp CL installed in a cavity, and a microprocessor 2 controlling the key input portion 1 and the cavity lamp CL, etc. The microprocessor 2 stops driving of the sub-relay RY1 when the cooking cancellation key is selected after the door is opened before/after the cooking starts, and also controls the whole cooking operation. When the cooking cancellation key is not selected, the microprocessor 2 stops the driving of the sub-relay RY1 after the predetermined time passes. When the driving of the sub-relay RY1 stops, the cavity lamp CL is turned off.

The method for controlling the cavity lamp of the above microwave oven comprises a first step for determining whether a door is opened, a second step for identifying cooking state by determining whether a cooking key of a key input portion is selected when the door is opened, a third step for identifying whether the cooking cancellation key of the key input portion is selected when the door not opens in the cooking state, a fourth step for turning off a cavity lamp when the cooking cancellation key is selected in the third step, a fifth step for determining whether the open time of the door passes beyond an established predetermined time in advance, and a sixth step for turning off the cavity lamp when the open time of the door passed beyond the predetermined time.

The open time of the door of the fifth step is measured by a timer when the cooking cancellation key is not selected in the third step. The established predetermined time is stored in a memory (not shown). The sub-relay RY1, the timer (not shown), and the memory are controlled by a microprocessor 2. The method for controlling cavity lamp further comprises a step for turning on the cavity lamp CL when the cooking cancellation key is re-selected after the cavity lamp CL has been turned on. That is, when the door opens so that the cavity lamp CL is turned on, the user presses the cooking cancellation key to turn off the cavity lamp CL manually. Then the user re-presses the cooking cancellation key after the cavity lamp CL is turned off automatically or manually, so the cavity lamp CL is turned on.

Hereinbelow, the operation and the effect of the method for controlling a cavity lamp of a microwave oven in accordance with the present invention is described.

Figure 2:
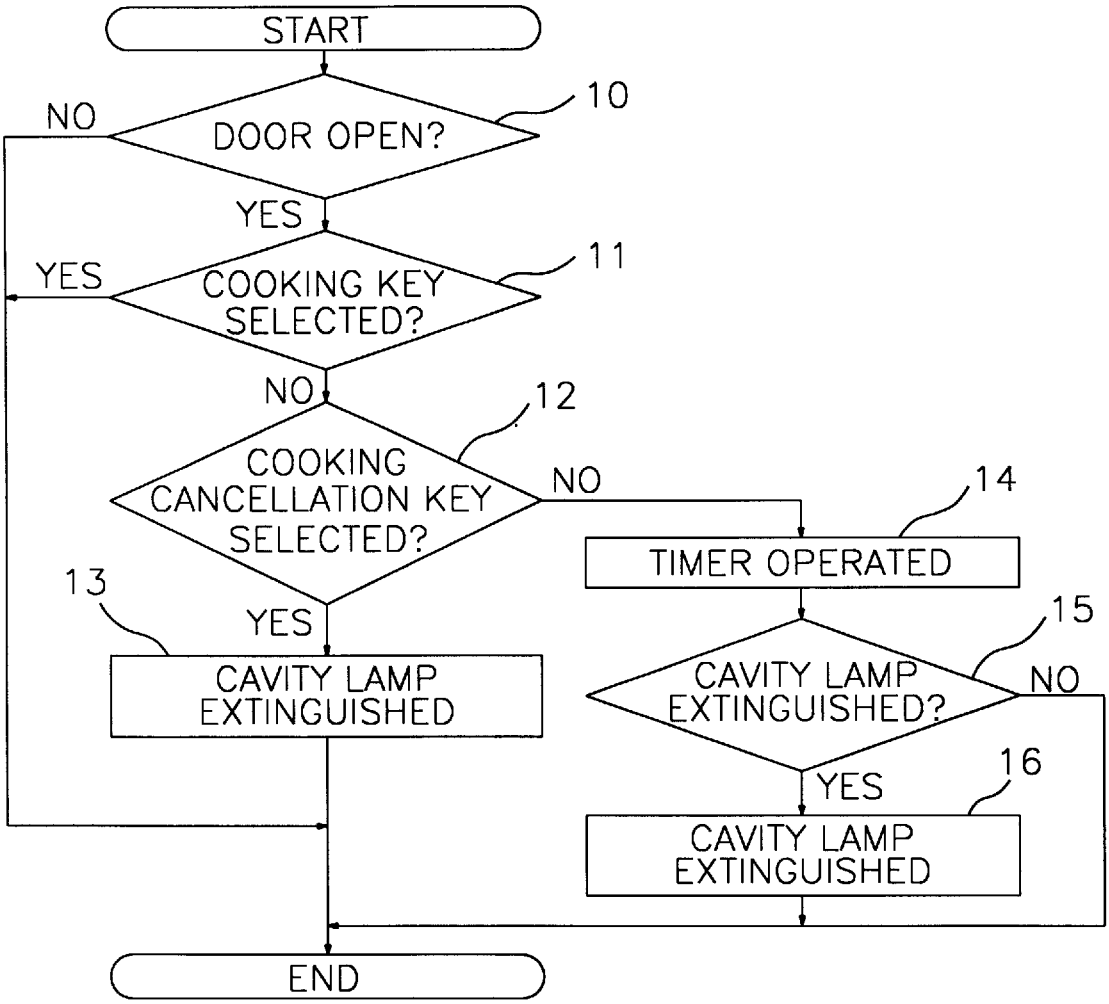
FIG. 2 is a flow chart showing a method for controlling the cavity lamp in accordance with the present invention.

FIG. 2 is a flow chart showing method for controlling the cavity lamp in accordance with the present invention. As shown in this figure, when the electric power is supplied to the microwave oven, the microprocessor 2 determines whether the door is opened 10. When the door is opened, the microprocessor 2 identifies cooking state by determining whether the cooking key of the key input portion 1 is selected 11. The microprocessor 2 then identifies whether the cooking cancellation key of the key input portion 1 is selected when the door is not opened during the cooking state 12. When the cooking cancellation key is selected, the microprocessor 2 turns off the cavity lamp CL 13. When the door is opened and both the cooking key and the cooking cancellation key are not selected, the timer operates 14 so that the microprocessor 2 determines whether the open time of the door passes beyond an established predetermined time in advance which is stored in the memory, for example 5 minutes 15. Therefore, when the open time of the door passes beyond 5 minutes, the cavity lamp CL is turned off 16.

In the above description and illustration, the predetermined time stored in the memory is 5 minutes. However, the above predetermined time can be established as any appropriate time by taking the necessary condition of the user into consideration to be stored in the memory.

As described above, by the method for controlling a cavity lamp of a microwave oven, the cavity lamp turned on when a door is opened is turned off automatically or manually so that life of the cavity lamp is lengthened and loss of electric power is reduced.

In the above, the present invention is described in detail by using the preferred embodiment, but the invention is not limited to the above embodiment. It should be obvious to people skilled in the conventional art that modifications can be made to the invention as described above without departing from the spirit or the scope of the invention. However the invention is limited by the accompanying claims as below.

What is claimed is:

1. A method of controlling a cavity lamp of a microwave oven comprising the steps of:

a) determining whether a door is opened;

b) identifying cooking state by determining whether a cooking key of a key input portion is selected when the door is opened in step a);

c) identifying whether a cooking cancellation key of the key input portion is selected when any cooking key of the key input portion is not selected in the step b);

d) determining whether the door is open for more than a predetermined time in advance when the cooking cancellation key is not selected in step c); and e) turning off the cavity lamp when the cooking cancellation key is selected in step c) or when the door open time duration exceeds the predetermined time in the step d).

2. The method as claimed in claim 1, wherein the microwave oven includes a sub-relay, and step e) comprises the step of turning off the cavity lamp by stopping driving of the sub-relay.

3. The method as claimed in claim 2, wherein the door open time duration in step e) is measured by a timer.

4. The method as claimed in claim 3, wherein the predetermined time is stored in a memory.

5. The method as claimed in claim 4, wherein the sub-relay, the timer and the memory are controlled by a microprocessor.

6. The method as claimed in claim 1, further comprising the step of turning on the cavity lamp when the cooking cancellation key is re-selected while the cavity lamp is turned off.

7. A method of controlling a cavity lamp of a microwave oven comprising the steps of:

a) determining whether a door is opened;

b) identifying a cooking state by determining whether a cooking key of a key input portion is selected when the door is opened;

c) identifying whether the cooking cancellation key of the key input portion is selected any cooking key of the key input portion is not selected in the step b);

d) determining whether an open time of the door, as measured by a timer, passes beyond a predetermined time, which is established in advance and stored in a memory, when the cooking cancellation key is not selected in the step c);

e) turning off the cavity lamp by stopping driving of a sub-relay when the cooking cancellation key is selected in the step c) or when the open time of the door exceeds the predetermined time in the step d); and f) turning on the cavity lamp when the cooking cancellation key is re-selected while the cavity lamp is turned off.

8. The method as claimed in claim 7, wherein the sub-relay, the timer, and the memory are controlled by a microprocessor.

* * * * *